US006263841B1

(12) United States Patent
Beveridge

(10) Patent No.: US 6,263,841 B1
(45) Date of Patent: Jul. 24, 2001

(54) TWO STROKE ENGINE HAVING REDUCED EMISSIONS

(76) Inventor: John Herbert Beveridge, P.O. Box 202, San Clemente, CA (US) 92674

( * ) Notice: Subject to any disclaimer, the term of this patent is extended or adjusted under 35 U.S.C. 154(b) by 0 days.

(21) Appl. No.: 09/431,627

(22) Filed: Nov. 2, 1999

(51) Int. Cl.[7] ..... F02B 33/04
(52) U.S. Cl. ..... 123/73 R; 123/65 A
(58) Field of Search ..... 123/65 PE, 65 V, 123/73 PP, 73 R, 65 A, 73 AF

(56) References Cited

U.S. PATENT DOCUMENTS 890,335 * 6/1908 Claus ..... 123/73 AA
2,844,131 7/1958 Beveridge ..... 123/73 A
4,732,117 * 3/1988 Tanahashi et al. ..... 123/65 PE
5,081,961 * 1/1992 Paul et al. ..... 123/51 B

* cited by examiner

*Primary Examiner*—Tony M. Argenbright
*Assistant Examiner*—Katrina B. Harris

(57) ABSTRACT

A simple, piston ported, two stroke engine having low weight, small size, low fuel consumption, enhanced power output and reduced exhaust emissions. A rotary exhaust valve adjacent to the cylinder exhaust ports closes the exhaust at completion of cylinder blowdown and as the cylinder inlet ports open. A crankcase pump forces fresh, cold, dense air plus fuel mixture into the cylinder via the cylinder inlet ports. Thus, the cylinder exhausting process is separate from the cylinder filling process and no air plus fuel mixture flows out the exhaust. Also, to ensure reliable ignition every cycle, a uniquely contoured top surface on the piston concentrates and delivers compressed, dense, air plus fuel mixture to the ignitor in the combustion chamber.

16 Claims, 3 Drawing Sheets

CYLINDER VALVING EVENTS

TWO STROKE ENGINE HAVING REDUCED EMISSIONS

FIELD OF INVENTION

This invention concerns two stroke piston engines having negligible loss of air plus fuel mixture during the cylinder exhausting and filling processes.

BACKGROUND

Conventional two stroke engines with carburetor fuel systems have a significant loss of air plus fuel mixture into the exhaust system during the cylinder scavenging process. Also, during low torque or part load operation, misfiring occurs. Misfiring causes unburned fuel to enter the exhaust system on the next cycle. Unburned fuel in the exhaust system increases specific fuel consumption and creates environmental pollution. These shortcomings must be overcome to ensure the future of low weight, high power output, relatively simple, and inexpensive two stroke engines.

OBJECTS AND ADVANTAGE

An object of this invention is to provide a method for exhausting and filling the cylinder with fresh charge while incurring negligible loss of air plus fuel mixture into the exhaust system.

Another object is to prevent loss of air plus fuel mixture into the exhaust system without significantly altering the low weight, high power output and low cost of the two stroke engine.

Another object is to improve the specific fuel consumption.

Another object is to increase specific power output.

Another object is to ensure the reliable ignition of the compressed air plus fuel mixture every cycle.

Another object is to significantly reduce exhaust emissions.

Further objects and advantages of my invention will become apparent from a consideration of the drawings and ensuing descriptions.

SUMMARY

Engines of this invention retain the good features of conventional two stroke engines: simple, low cost, low weight, small size, and high power output, without their major shortcomings. Engines of this invention have increased specific power output without large tuned exhaust systems, have reduced specific fuel consumption, and greatly reduced exhaust emissions.

DESCRIPTION OF PREFERRED EMBODIMENT

Valving

Figure 1:
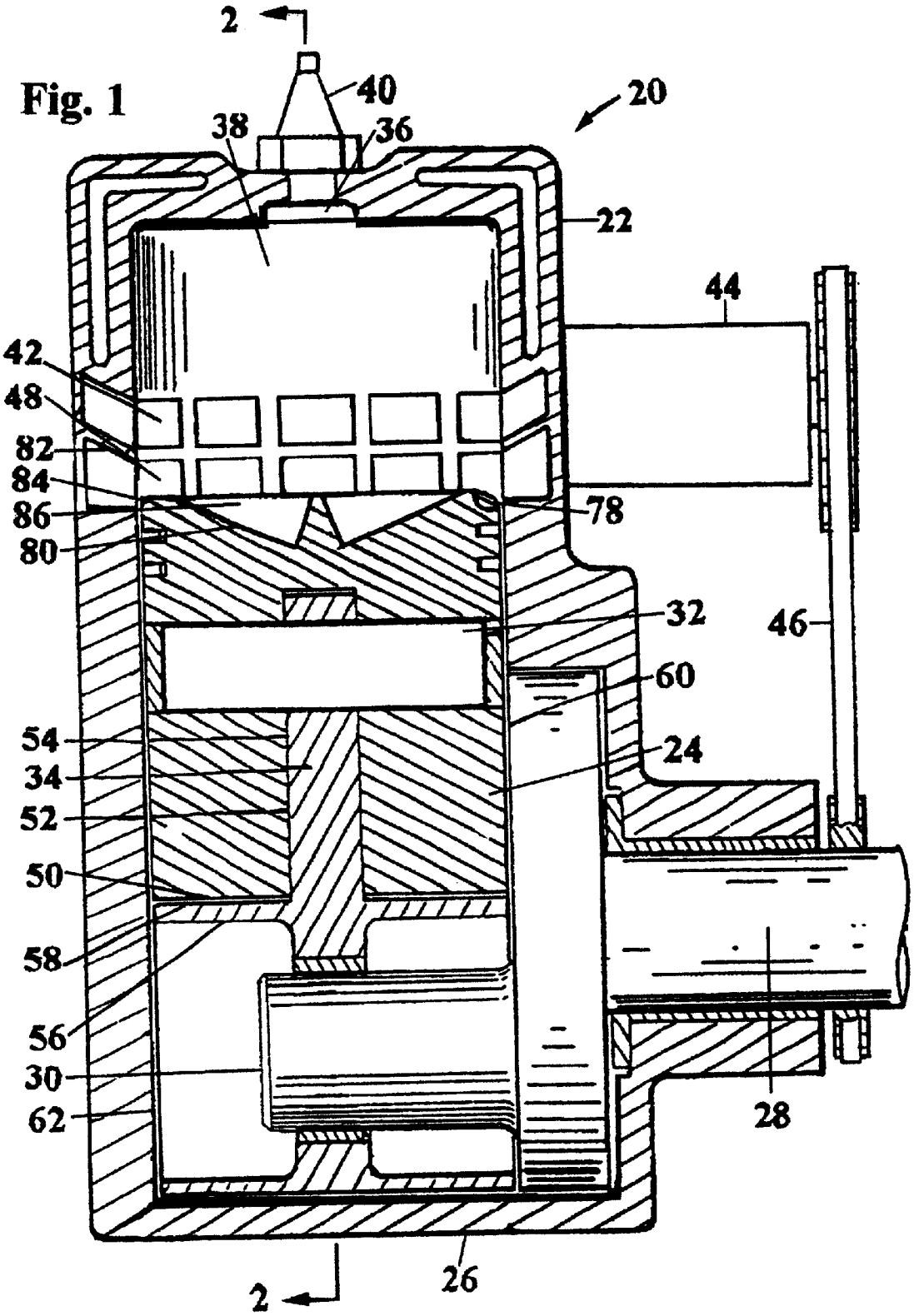
FIG. 1 is a cross section of a single cylinder, two stroke engine through the axis of the crankshaft and through the axis of the cylinder.
Figure 2:
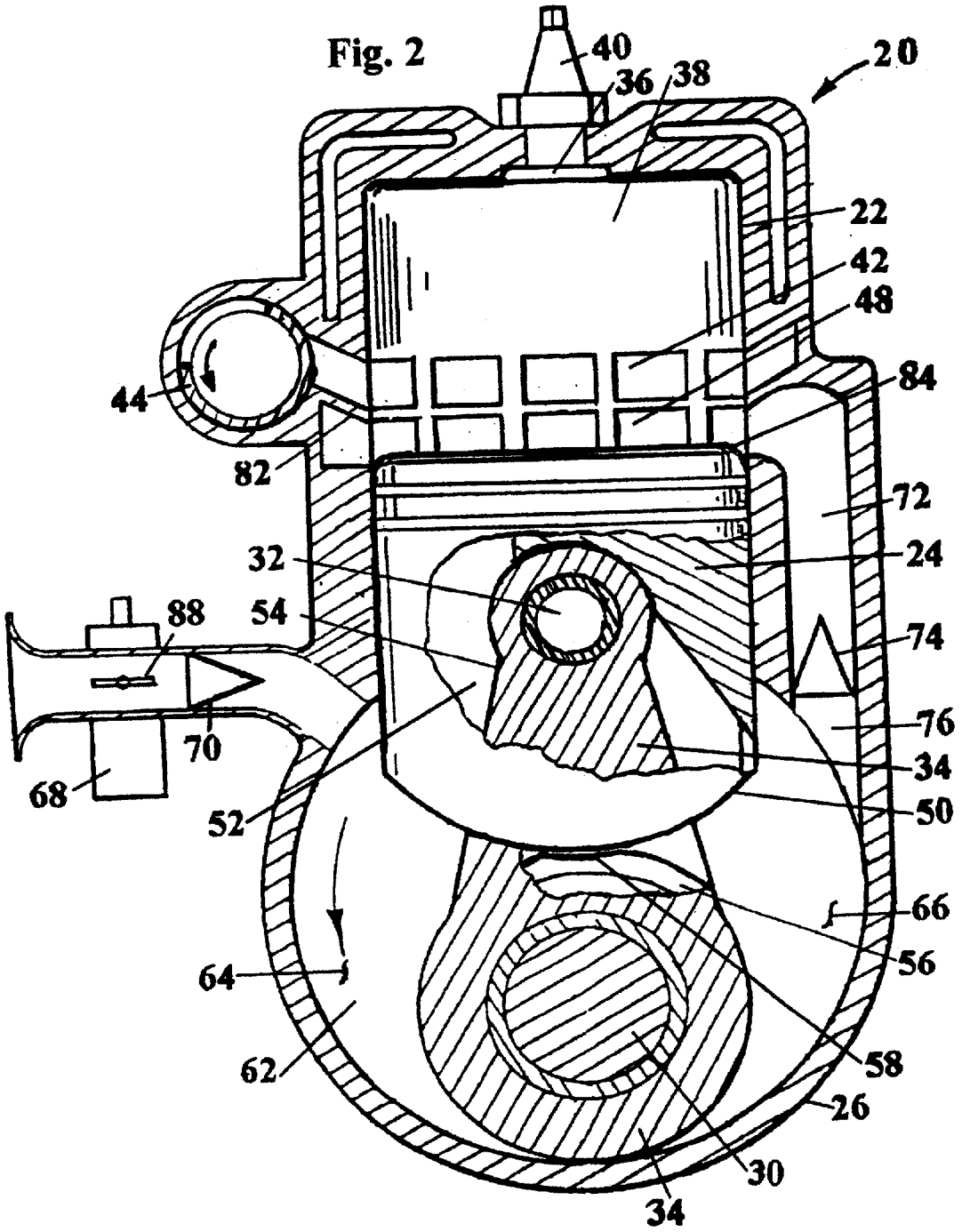
FIG. 2 is a cross section of the engine of FIG. 1, normal to the axis of the crankshaft and through the axis of the cylinder.

In FIGS. 1 and 2 there is shown a single cylinder, two stroke engine, 20. Engine 20 has a cylinder 22 with a piston

24 reciprocatable therein. Crankcase 26, attached to cylinder 22, has a crankshaft 28 rotatably mounted therein. Crankshaft 28 has a crankpin 30. Piston 24 has a piston pin 32. The upper end of connecting rod 34 is pivotally attached to piston 24 by piston pin 32. The lower end of connecting rod 34 is rotatably mounted on crankpin 30. The upper or head end of cylinder 22 has a combustion chamber 38 with receiver 36 and an ignitor 40. Cylinder 22 has exhaust port(s) 42 which are opened on the downstroke of piston 24. After piston 24 opens cylinder exhaust ports) 42, rotary exhaust valve 44 (adjacent to cylinder exhaust ports 42) closes as piston 24 opens cylinder inlet port(s) 48. Inlet port(s) 48 are closed on the upstroke of piston 24.

Crackcase Pump

The lower end of piston 24 has radiused surfaces 50. Also, the lower end of piston 24 has a slot 52. Connecting rod 34 has a blade 54 which has a close clearance fit in slot 52. The lower end of connecting rod 34 has circular extensions 56. Extensions 56 have cutouts 58 which have close clearances relative to the radiused lower surfaces 50 of piston 24. The width of the interior of crankcase 26 is essentially the same dimension as the bore of cylinder 22. Crankshaft 28 has a circular crankcheek 60 which forms one end of crankcase 26. The opposite end 62 of crankcase 26 is fixed and is aligned with the bore of cylinder 22. Piston 24 and connecting rod extensions 56 have a close clearance relative to the ends 60 and 62 of crankcase 26. The lower end of connecting rod 34 and extensions 56 have a radial close clearance relative to the bore of crankcase 26 during a portion of each revolution of crankshaft 28. Thus, connecting rod 34 and piston 24 form a partition dividing the interior of crankcase 26 into two chambers during a portion of each revolution of crankshaft 28. One chamber, the suction chamber 64, increases in volume and the other chamber, the compression chamber 66, decreases in volume as crankshaft 28 revolves. Suction chamber 64 is in communication with carburetor 68 via optional suction check valve 70. Carburetor 68 has a throttle control valve 88. Compression chamber 66 is in communication with cylinder inlet ports 48 via transfer passage 72. Discharge check valve 74 is adjacent to chamber 66 in transfer passage 72. In short, chambers 64 and 66 form a crankcase pump 76.

Mixture Position control

Piston 24 has a contoured upper surface 78 having a central cavity 80 designed to concentrate cold, dense air plus fuel mixture in a specific location, i.e. opposite the ignitor 40 in receiver 36 in combustion chamber 38. Cylinder inlet ports 48 have there upper surfaces 82 angled downward to impinge inflow onto the smoothly contoured upper surface 78 of piston 24. Also, the upper edge of piston 24 has a radius 84 to enable inflowing mixture to cling to the contoured upper surface 78. The contoured upper surface 78 and cavity 80 may have radial ribs 86 to stabilize the inflow. When piston 24 is at top dead center, the volume of cavity 80 forms the major portion of the volume of combustion chamber 38.

Operation

Figure 3:
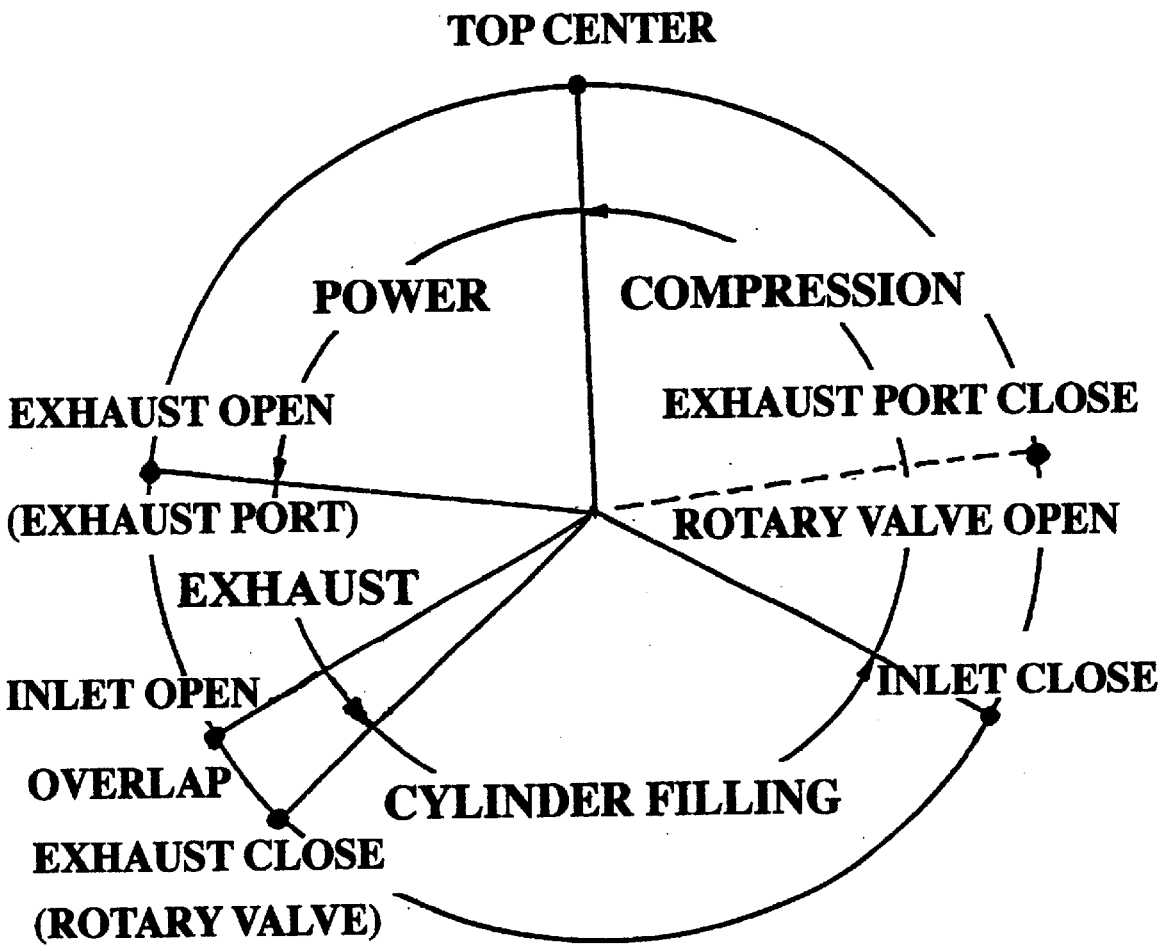
FIG. 3 is a timing diagram for the major valving events of the cylinder.

The operation of two stroke engine 20 is significantly different from the operation of conventional two stroke engines. The major difference is the very early closure of the rotary exhaust valve 44, which acts to separate the cylinder exhausting process from the cylinder filling process. This prevents unburned air plus fuel mixture from passing into the exhaust system during the cylinder filling process. During the downstroke of piston 24, or power stroke of engine 20, cylinder exhaust ports 42 open and rotary exhaust valve 44, driven by timing belt 46, is also open allowing hot products of combustion to exit cylinder 22. As the cylinder exhausting process or blowdown nears completion, the pressure in cylinder 22 approaches atmospheric pressure (exhaust system pressure). The continuing down motion of piston 24 opens cylinder inlet ports 48 as rotary exhaust valve 44 closes. Crankcase pump 76 forces pressurized air plus fuel mixture into the volume of cylinder 22 via transfer passage 72, discharge check valve 74, and cylinder inlet ports 48. As piston 24 rises, cylinder inlet ports 48 close and the compression process begins. Late in the compression stroke, ignitor 40 causes ignition of the compressed air plus fuel mixture in combustion chamber 38. The cycle is complete when piston 24 starts its next power stroke. From the above description, it will be noted that the cylinder exhausting process and the cylinder filling process are substantially separate. FIG. 3 is a timing diagram showing the relationship of cylinder exhausting and cylinder filling processes relative to the power and compression processes. Because the cylinder exhausting process is separated from the cylinder filling process , unburned air plus fuel mixture cannot escape into the exhaust system provided ignition and combustion occur every cycle.

Overlap

As shown in FIG. 3, overlap is defined as a delay in closing exhaust valve 44 relative to opening of the cylinder inlet ports 48. From a practical standpoint, some overlap is allowable and desirable. One reason is that a small overlap significantly increases the product (exhaust valve area)× (time). The limited duration of the exhausting process tends to inhibit the cylinder blowdown process. Secondly, the descending piston provides an immediately available volume for inflowing mixture. Thirdly, inertia of the discharge check valve 74 and the inertia of the air plus fuel mixture tend to delay inflow even though the inlet ports 48 are opening. Fourthly, the actual inlet port area is initially very small.

Misfiring-Part Load Operation

Crankcase Pump Characteristics

A common problem of conventional crankcase scavenged two stroke engines is misfiring at low loads. Misfiring causes unburned air plus fuel mixture to enter the exhaust system on the following cycle. Misfiring occurs for several reasons. One cause is the "soft" pumping characteristic of the conventional crankcase pump. Thus, the crankcase pump's output is very sensitive to delivery pressure especially at small capacities per cycle. Random pressure waves from the exhaust system returning to the cylinder are of sufficient magnitude to cause fresh mixture entering the cylinder to backflow into the crankcase. The result is a "shorted" charge which results in partial combustion or a complete misfire on the ensuing cycle. Please note in this invention, the exhaust system is not in communication with the cylinder during the cylinder filling process hence pressure waves in the exhaust system are not a concern.

Crankcase pump 76 of engine 20 has a "stiff" characteristic due to its very small clearance volume and the elimination of several leakage paths. The original crankcase pump of this type was described in my U.S. Pat. No. 2,844,131, issued on Jul. 22, 1958. Improvements incorporated in the current pump include elimination of the "flats" in the lower cylinder bore to reduce leakage plus radiused surfaces 50 on the bottom of the piston 24 and cutouts 58 to improve sealing and to reduce clearance volume. Also, optional discharge check valve 74 adds to pump "stiffness" and improves capacity by preventing reexpansion of already compressed mixture in passage 72. As a result of these improvements, crankcase pump 76 delivers a consistent volume of air plus fuel mixture each cycle and has increased discharge pressure capability.

The latter is needed for this invention.

While discussing the pump characteristic it should be noted that with throttled inlet pressure (part load), the delivery of pump outflow to the cylinder is delayed relative to the opening of the cylinder inlet ports. As a result, the "effective" overlap rapidly becomes zero. Effective overlap refers to the actual start of cylinder inflow via cylinder inlet ports 48 compared with closure of exhaust valve 44.

Fresh Charge at Ignitor

A second cause for misfiring at part load is that fresh, dense air plus fuel mixture is not located at the ignitor when ignition is desired Engine 20 is designed so dense, cold air plus fuel mixture is present in receiver 36 at the ignitor 40 as piston 24 approaches top center. At low loads, the volume of fresh, cold, dense air plus fuel mixture is less than the volume of hot products of combustion in the cylinder. Piston 24 has a contoured upper surface 78 shaped to cause the dense air plus fuel mixture to "sink" into the cavity 80. This occurs due to the inflowing mixture onto the top surface 78 of piston 24 and the large upward acceleration of the dense mixture adjacent to piston 24. (The "effective" difference in density can be (0.075–0.025)×(1000 g/1 g)=50 lbs/cu. ft. or approximately the difference in density between water and air.) Hot, low density products of combustion "float" upward as the cold, dense air plus fuel mixture sinks. On the upward stroke when piston 24 starts to slow, the cold, dense air plus fuel mixture adjacent to piston 24 tends to continue its upward velocity, especially the dense air plus fuel mixture in cavity 80. The upward flow from cavity 80 sucks adjacent cold, dense air plus fuel mixture toward and behind the upflowing dense fluid. This "bubble" of dense, cold air plus fuel mixture impinges on the ignitor 40 in receiver 36 in combustion chamber 38. Thus at/near top center, fresh, cold, dense air plus fuel mixture is present at ignitor 40 and is available for ignition.

Power Output—Supercharge

At wide open throttle, the pumping capacity of crankcase pump 76 is greater than the piston displacement. Since an insignificant amount of pumped inlet flow is lost into the exhaust system, the pumped air plus fuel mixture must be inside cylinder 22. Hence, cylinder, 22 is supercharged. This increased volume/weight of charge, or supercharge, results in increase power output. Use of a crankcase pump to supercharge a single cylinder two stroke engine is unique.

Specific Fuel Consumption

In comparison with conventional two stroke engines, engine 20 has reduced specific fuel consumption. There are two reasons, elimination of wasted fuel in the exhaust, and increased power output due to supercharge.

Stroke-Bore Ratio

Engines of this invention may be designed with less concern about port area relative to piston area, a key factor in the selection of stroke-bore ratio. Scavenge flow profiles arc not a problem because the exhaust outflow process is separate from the cylinder filling inflow process. Accordingly, smaller stroke/bore ratios may be selected, thus allowing smaller engine size, increased engine speed and power with reduced engine friction.

Exhaust System

The exhaust valving of this invention should not be confused with an exhaust port having an adjustable upper edge as commonly used in two stroke motorcycles and off-road vehicles. The function of the adjustable upper edge exhaust port is to modify the duration of exhaust port open in response to a change in speed of the engine. In this way, the engine can "stay on the tuned exhaust pipe" and produce high torque over a wide range of speed. Engines of this invention do not benefit from a conventional tuned exhaust pipe.

Fuel System

In this disclosure, carburetor 68 supplies an air plus fuel mixture in which the fuel burns completely. Other more elaborate and expensive fuel injection systems, such as those used in the outboard engine and the automobile industries, may be selected. When cylinder direct fuel injection is used, crankcase pump 76 delivers air or air plus oil only.

Conclusions, Ramifications, and Scope

Engines of this invention have increased power, lower specific fuel consumption and greatly reduced hydrocarbon emissions.

Although the description above contains many specifics, these should not be construed as limiting the scope of the invention but merely providing illustrations of the presently preferred embodiment of the invention. For example, poppet exhaust valves in the head end of the cylinder can replace the cylinder exhaust ports and the adjacent rotary exhaust valve, the engine may be multicylinder, etc. Thus the scope of this invention should be determined by the appended claims and their legal equivalents, rather than by the example given.

I claim:

1. A method for exhausting and filling the cylinder of a two stroke engine with negligible loss of air plus fuel mixture comprising the steps of:

a. igniting a compressed air plus fuel mixture in a combustion chamber thereby forming hot, high pressure products of combustion, and b. expanding said hot, high pressure products of combustion in said cylinder during the downstroke of its piston thereby doing work, and c. opening an exhaust valving means allowing said products of combustion to outflow said cylinder during the downstroke of said piston, and d. substantially closing said exhaust valving means as an inlet valving means is opening, and e. using a pumping means to force air plus fuel mixture into said cylinder via said inlet valving means, and f. using the connecting rod of said two stroke engine as a pumping element of said pumping means, and g. closing said inlet valving means during the upstroke of said piston, and h. compressing said air plus fuel mixture in said cylinder in preparation for ignition of said compressed air plus fuel mixture in said combustion chamber, whereby said cylinder is exhausted and filled with air plus fuel mixture with negligible outflow of air plus fuel mixture via said exhaust valving means.

2. A method for exhausting, filling and supercharging a two stroke engine cylinder comprising the steps of:

a. igniting a compressed air plus fuel mixture in a combustion chamber thereby forming hot, high pressure products of combustion, and b. expanding said hot, high pressure products of combustion in a cylinder during the downstroke of a piston thereby doing work, and c. opening an exhaust valving means allowing said products of combustion to outflow said cylinder, and d. substantially closing said exhaust valving means as an inlet valving means is opening, and e. using a crankcase pump to force air plus fuel mixture into said cylinder via said inlet valving means, and f. closing said inlet valving means during the upstroke of said piston, and g. compressing said air plus fuel mixture in said cylinder in preparation for ignition of said compressed air plus fuel mixture in said combustion chamber, whereby said cylinder is exhausted, filled and supercharged with air plus fuel mixture.

3. A two stroke engine having reduced emissions comprising:

at least one cylinder having a combustion chamber, at least one piston reciprocatable in said cylinder, mechanical means causing said piston to reciprocate in said cylinder, said combustion chamber containing hot, high pressure products of combustion when said piston is near top dead center, said piston expanding said products of combustion during its downstroke, said cylinder having exhaust valving means, said exhaust valving means opening at a predetermined position during the downstroke of said piston, said exhaust valving means allowing expanded products of combustion to exit from said cylinder, said cylinder having inlet valving means, said inlet valving means opening at a predetermined position during the downstroke of said piston, said inlet valving means in communication with a source of pressurized air plus fuel mixture, said exhaust valving means substantially closing at a predetermined position during the downstroke of said piston, said source of pressurized air plus fuel mixture filling said cylinder via said inlet valving means, said inlet valving means closing at a predetermined position during the upstroke of said piston, whereby said cylinder is exhausted and filled with air plus fuel mixture while incurring a negligible outflow of air plus fuel mixture via said exhaust valving means.

4. A two stroke engine as in claim 3 wherein said combustion chamber has an ignitor.

5. A two stroke engine as in claim 3 wherein said combustion chamber has a receiver.

6. A two stroke engine as in claim 3 wherein the closing of said exhaust valving means is sustantially coincident with the opening of said inlet valving means.

7. A two stroke engine as in claim 3 wherein said piston has a contoured upper surface including a cavity, said cylinder having a combustion chamber with an ignitor, said cavity in said piston being opposite said ignitor in said combustion chamber.

8. A two stroke engine as in claim 3 wherein said piston has a contoured upper surface, said upper surface having substantially radial ribs.

9. A two stroke engine as in claim 3 wherein said piston has a substantial radius on its upper edge.

10. A two stroke engine as in claim 3 wherein said mechanical means includes, a crankshaft rotatably mounted in a crankcase attached to said cylinder, a connecting rod coupling said crankshaft to said piston, said connecting rod and said piston forming partition means dividing said crankcase in two chambers during a portion of each revolution of said crankshaft.

11. A two stroke engine as in claim 3 wherein said mechanical means includes a crankshaft rotatably mounted in a crankcase attached to said cylinder, said crankshaft having a circular crankcheek with a crankpin, said crankcheek forming one end of said crankcase, a fixed end aligned with the bore of said cylinder forming the opposite end, said piston having a radiused bottom surface with a central slot, said piston having a piston pin, a connecting rod having an upper end pivotally attached to said piston pin and said connecting rod having a lower end rotatably mounted on said crankpin, said upper end of said connecting rod having a blade shape forming a close clearance relative to said slot in said piston, said lower end of said connecting rod having lateral circular extensions projecting substantially the dimension of the width of said crankcase thus forming a close clearance relative to said ends of said crankcase, said extensions forming a close clearance relative to said radiused lower surfaces of said piston, said lower end of said connecting rod including said extensions forming a radial close clearance relative to the bore of said crankcase, thus said piston and said connecting rod form partition means separating the volume of said crankcase into two chambers during a portion of each revolution of said crankshaft.

12. A two stroke engine as in claim 3 wherein said source of pressurized air plus fuel mixture is a crankcase pump.

13. A two stroke engine as in claim 3 wherein said source of pressurized air plus fuel mixture is a crankcase pump and a discharge check valve.

14. A two stroke engine as in claim 3 wherein said source of pressurized air plus fuel mixture is a crankcase pump, said crankcase pump including said piston and a connecting rod, said piston having a bottom with a radiused surface, said connecting rod having circular extensions, said circular extensions having cutouts, said cutouts forming a close clearance relative to said bottom of said piston.

15. A two stroke engine as in claim 3 wherein said exhaust valving means includes a cylinder exhaust port(s) and a rotary exhaust valve.

16. A two stroke engine as in claim 3 wherein said inlet valving means is a cylinder inlet port(s).

| Reference Numerals In Drawings |
|---|
| 20 engine |
| 22 cylinder |
| 24 piston |
| 26 crankcase |
| 28 crankshaft |
| 30 crankpin |
| 32 piston pin |
| 34 connecting rod |
| 36 receiver |
| 38 combustion chamber |
| 40 ignitor |
| 42 cyl. exh. port |
| 44 rotary exh. valve |
| 46 timing belt |
| 48 inlet port |
| 50 radius surface |
| 52 slot |
| 54 blade |
| 56 extensions on rod |
| 58 cutouts |
| 60 crankcheck |
| 62 end of c'case |
| 64 suction chamber |
| 66 compression chamber |
| 68 carburetor |
| 70 suction ckv |
| 72 transfer passage |
| 74 discharge ckv |
| 76 crankcase pump |
| 78 contour upper surface |
| 80 cavity in piston |
| 82 upper surface inlet port |
| 84 radius edge piston |
| 86 radial ribs |
| 88 throttle control valve |

* * * * *